US008538309B2

(12) United States Patent
Ban

(10) Patent No.: US 8,538,309 B2
(45) Date of Patent: Sep. 17, 2013

(54) PRINTING APPARATUS

(75) Inventor: Naomichi Ban, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 605 days.

(21) Appl. No.: 12/732,340

(22) Filed: Mar. 26, 2010

(65) Prior Publication Data

US 2011/0076076 A1 Mar. 31, 2011

(30) Foreign Application Priority Data

Sep. 28, 2009 (JP) ..... 2009-222188
Mar. 15, 2010 (JP) ..... 2010-057693

(51) Int. Cl.
*G03G 15/00* (2006.01)
*B65H 85/00* (2006.01)
*B41J 3/60* (2006.01)

(52) U.S. Cl.
USPC ..... 399/364; 399/401; 400/188

(58) Field of Classification Search
USPC ..... 399/364, 401
See application file for complete search history.

(56) References Cited

U.S. PATENT DOCUMENTS

| | | | | |
|---|---|---|---|---|
| 4,943,832 | A | 7/1990 | Emori | |
| 6,775,514 | B2 * | 8/2004 | Korhonen | 399/389 |
| 7,114,867 | B2 * | 10/2006 | Ohashi et al. | 400/642 |
| 2001/0011794 | A1 | 8/2001 | Chihara | |

FOREIGN PATENT DOCUMENTS

| | | | | |
|---|---|---|---|---|
| JP | H02-110087 | A | | 4/1990 |
| JP | 05053393 | A | * | 3/1993 |
| JP | 08030050 | A | * | 2/1996 |
| JP | H08-113434 | A | | 5/1996 |
| JP | 08272165 | A | * | 10/1996 |
| JP | A-H09-249342 | | | 9/1997 |
| JP | 2000-321827 | A | | 11/2000 |
| JP | 2001-206644 | A | | 7/2001 |
| JP | 2002014494 | A | * | 1/2002 |

(Continued)

OTHER PUBLICATIONS

Notification of Reasons for Refusal dated Aug. 23, 2011 received from the Japanese Patent Office from related Japanese Application No. 2010-057693, together with an English-language translation.

(Continued)

*Primary Examiner* — Daniel J Colilla
*Assistant Examiner* — Nguyen Q Ha
(74) *Attorney, Agent, or Firm* — Scully, Scott, Murphy & Presser, P.C.

(57) ABSTRACT

A printing apparatus comprising: a printing section including a conveyer, a reconveyer, and a printer; a sensor; a determination section; and a controller. The determination section determines whether a pair of the first sheet and the second sheet is eligible for the high-speed duplex printing based on the combination of the length of the first sheet and the length of the second sheet before the second sheet conveyed by the reconveyer. The controller controls the printing section to convey the first sheet and the second sheet to the reconveyer when the pair of the length of the first sheet and the second sheet is eligible for the high-speed duplex printing, and controls the printing section to eject at least one of the first and the second sheet when the pair of the length of the first and the second sheets is not eligible for the high-speed duplex printing.

5 Claims, 8 Drawing Sheets

(56) References Cited

FOREIGN PATENT DOCUMENTS

| | | | | |
|---|---|---|---|---|
| JP | 2002-091102 | A | | 3/2002 |
| JP | 2002091102 | A | * | 3/2002 |
| JP | 2004109623 | A | * | 4/2004 |
| JP | A-2005-082311 | | | 3/2005 |
| JP | 2005181876 | A | * | 7/2005 |
| JP | A-2005-181876 | | | 7/2005 |
| JP | A-2005-195808 | | | 7/2005 |
| JP | 2006313341 | A | * | 11/2006 |
| JP | 2007-030476 | A | | 2/2007 |
| JP | 2007039204 | A | * | 2/2007 |
| JP | 2007147808 | A | * | 6/2007 |
| JP | 2008268641 | A | * | 11/2008 |
| JP | 2009083122 | A | * | 4/2009 |
| JP | A-2009-086398 | | | 4/2009 |

OTHER PUBLICATIONS

Decision of Patent Grant dated Mar. 6, 2012 received from the Japanese Patent Office from related Japanese Application No. 2010-057693, together with an English-language translation.

* cited by examiner

| SUBSEQUENT / PRECEDING | A 4 | LETTER | LEGAL |
|---|---|---|---|
| A 4 | ○ | ○ | × |
| LETTER | ○ | ○ | ◎ |
| LEGAL | — | — | — |

(E)

(E)

PRINTING APPARATUS

CROSS-REFERENCE TO RELATED APPLICATIONS

The present application claims priority from Japanese Patent Application No. 2009-222188 filed on Sep. 28, 2009 and Japanese Patent Application No. 2010-057693 filed on Mar. 15, 2010, and the entire subject matter of which is incorporated herein by reference.

TECHNICAL FIELD

The present invention relates to a printing apparatus that performs duplex printing. More particularly, the present invention relates to a printing apparatus that is capable of performing duplex printing (hereinafter appropriately referred to as a high-speed duplex printing) where the printing apparatus prints one surface of a first sheet, prints one surface of a second sheet subsequent to the first sheet after the first sheet enters a reconveyer path, and prints the other surface of the first sheet in this order.

BACKGROUND

There is a related printing apparatus capable of high-speed duplex printing. The related printing apparatus adjust the number of the sheets to be conveyed based on the size of the sheets. Thereby, the related printing apparatus selects the most suitable feeding operation based on the size of the sheets. For example, such a related printing apparatus sets a size of sheets to be printed in advance, adjusts the number of sheets to a suitable number based on the sheet size set in advance, and conveys the suitable number of sheets.

However, the printing apparatus of the related art has the following problems. That is to say, in the related art technique, a sheet conveyance is controlled based on the assumption that the sheet size is set in advance and sheets of the set size are set on a feeding section. Since the size of the sheets is set in advance in the related art, it is not possible to convey the sheets in an appropriate manner in a case where a size of sheets actually conveyed is different from the size of sheets set in advance. Examples of such case are that users have made mistakes in sheet settings or that sheets were automatically fed from a different sheet tray in response to detection of absent of sheet.

SUMMARY

The exemplary embodiments of the present invention have been made to solve the problems of the printing apparatus according to the related art. That is, the exemplary embodiments of the present invention provide a printing apparatus that performs an appropriate duplex printing operation in accordance with the size of the sheet being actually conveyed.

The first aspect of the exemplary embodiments of the present invention is a printing apparatus comprising: a printing section comprising: a conveyer conveying a first sheet and a second sheet subsequent to the first sheet; a printer printing one surface and the other surface of the first sheet, and printing one surface and the other surface of the second sheet; and a reconveyer conveying the first sheet after printing the one surface of the first sheet and conveying the second sheet after printing the one surface of the second sheet, wherein the printing section performing a high-speed duplex printing where the printer prints the one surface of the first sheet, the one surface of the second sheet after the first sheet is in the reconveyer, and the other surface of the first sheet in this order; a sensor specifying a length of the first sheet while the conveyer conveys the first sheet and a length of the second sheet while the conveyer conveys the second sheet; a determination section determining whether a pair of the first sheet and the second sheet is eligible for the high-speed duplex printing based on the combination of the length of the first sheet and the length of the second sheet before the second sheet conveyed by the reconveyer; and a controller controlling the printing section to convey the first sheet and the second sheet to the reconveyer when the determination section determines the pair of the length of the first sheet and the length of the second sheet is eligible for the high-speed duplex printing, and controlling the printing section to eject at least one of the first sheet and the second sheet when the determination section determines the pair of the length of the first sheet and the length of the second sheet is not eligible for the high-speed duplex printing.

The printing apparatus of the exemplary embodiments of the present invention is a printing apparatus capable of high-speed duplex printing and specifies the sheet length of a sheet while conveying the target sheet. Especially, specifies the sheet length of the first sheet (preceding sheet) and the second sheet (target sheet) subsequent to the first sheet. Moreover, it is determined based on the combination of the identified sheet lengths of the preceding sheet and the target sheet whether the printing apparatus is able to continue the high-speed duplex printing or not. Then, based on the determination results, it is determined whether the respective sheets will be conveyed to the reconvey path or the respective sheets will be ejected without conveyance to the reconvey path. A combination for which high-speed duplex printing cannot be continued corresponds to a case, for example, where the sheet length of the target sheet is too large, and there is a possibility that conveying control based on the sheet length of the preceding sheet may result in a collision of the target sheet and the preceding sheet during the concurrent convey of both sheets.

That is, in the printing apparatus according to the exemplary embodiments of the present invention, the sheet length of a sheet (target sheet) being conveyed actually is specified, and conveyance of the respective sheets is controlled based on the determination results on the conveyability corresponding to the combination of the target sheet and the preceding sheet. Therefore, it is possible to perform the duplex printing operation more appropriately. For example, when the combination of sheets is inappropriate, by not conveying at least one of the target sheet and the preceding sheet to the reconvey path, it is possible to avoid troubles concerning the sheet convey. Moreover, there is a case where high-speed duplex printing is possible for a combination of sheets having different sheet sizes. For this reason, the high-speed duplex printing may be continued depending on the combination rather than uniformly applying error processing for stopping printing in all cases where the sheet sizes are different.

According to the present invention, it is possible to realize a printing apparatus that performs an appropriate duplex printing operation in accordance with the size of sheet being conveyed actually.

DESCRIPTION OF EXEMPLARY EMBODIMENTS

Hereinafter, an embodiment of a printing apparatus according to the present invention will be described with reference to the accompanying drawings. This embodiment applies the present invention to an electrophotographic printer that is capable of performing single-sided printing on two subsequent sheets and then performing printing on the other side of the sheet at the time of performing duplex printing.

[Overall Configuration of Printer]

Figure 1:
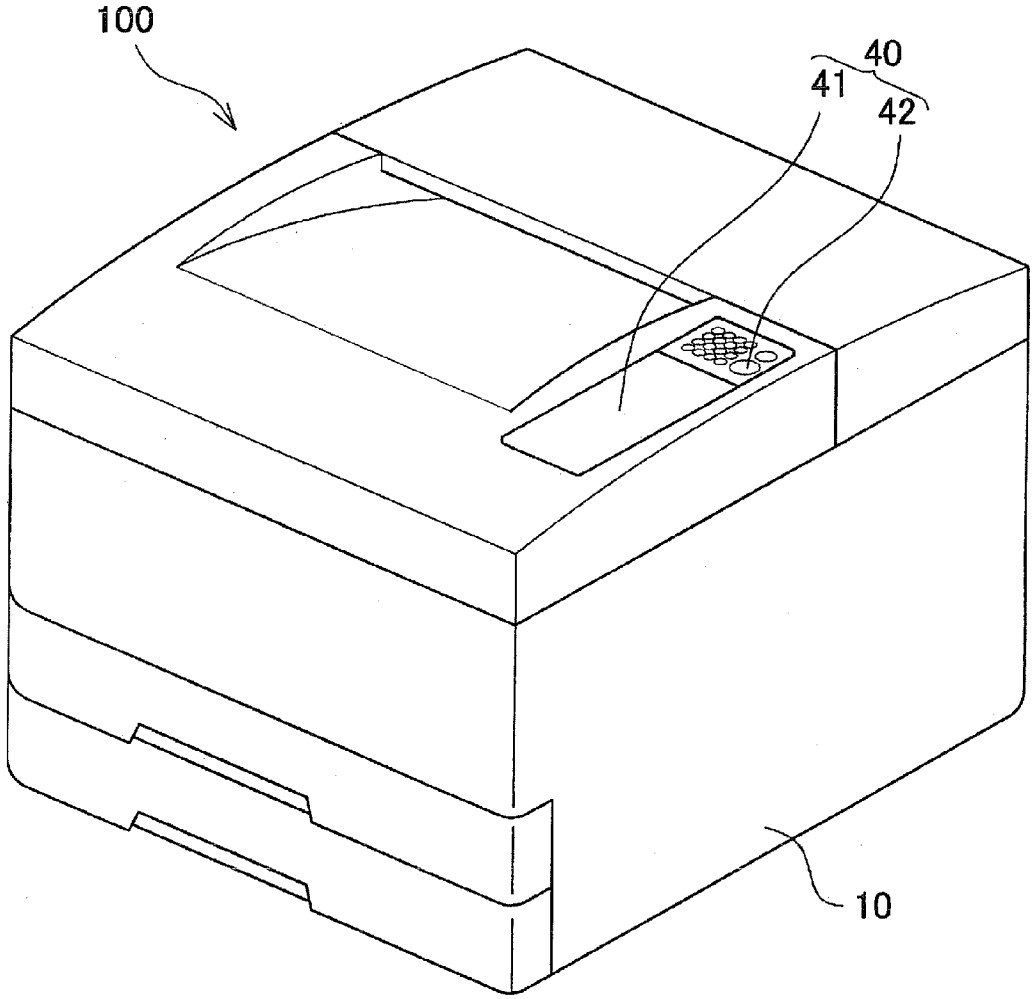
FIG. 1 is a perspective view showing a schematic configuration of a printer according to the embodiment.

As shown in FIG. 1, a printer 100 according to this embodiment includes a main section 10 that forms images on a sheet and an operation panel 40 that is positioned on the surface of the main section 10. The operation panel 40 includes a display section 41 formed of a liquid crystal display and a group of buttons 42 including a start key, a stop key, a number pad, and the like. With this operation panel 40, an operation status can be displayed to users, and users can perform an input operation on the printer 100.

[Internal Configuration of Printer]

Figure 2:
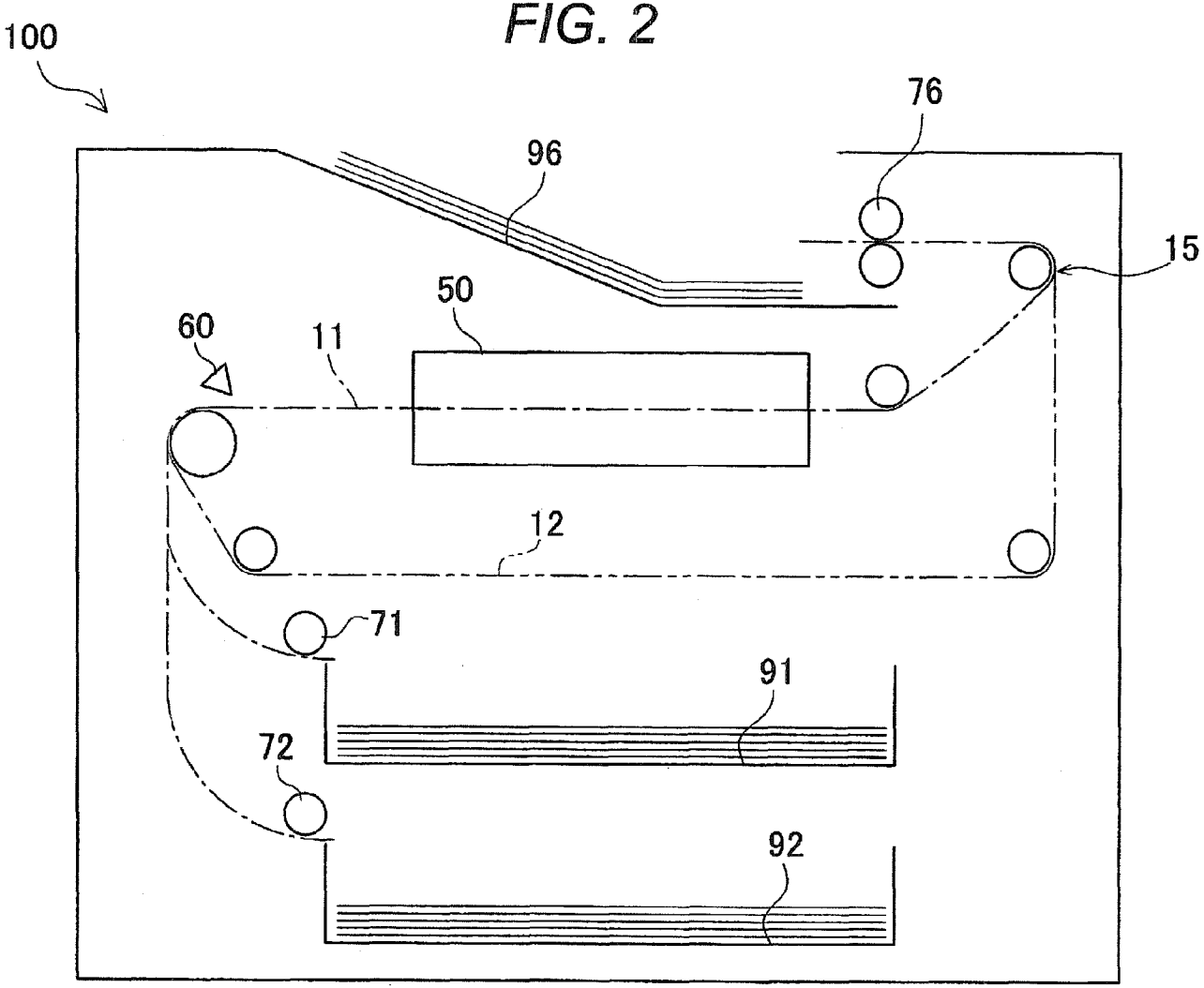
FIG. 2 is a schematic diagram showing an internal configuration of the printer shown in FIG. 1.
Figure 3:
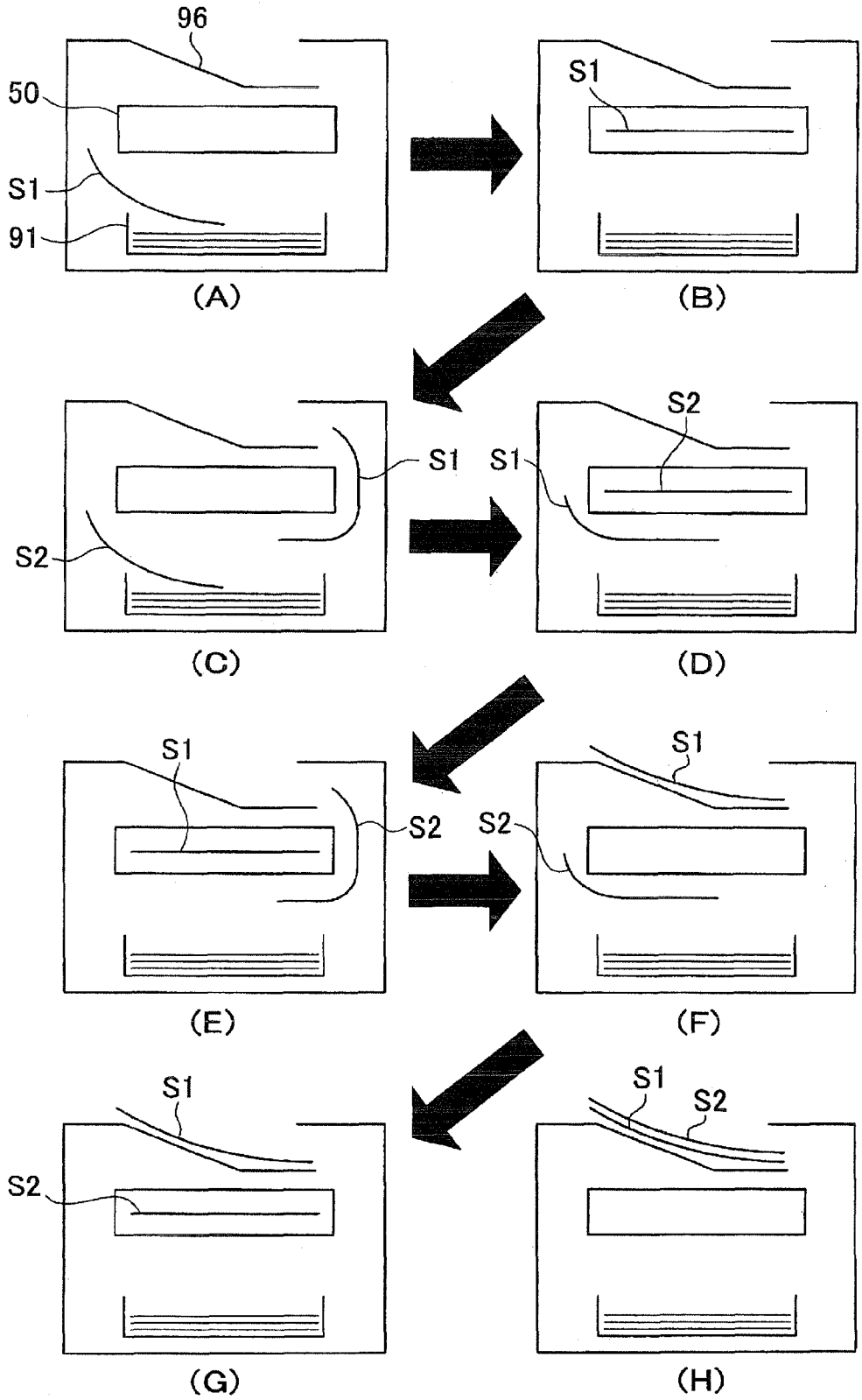
FIGS. 3A to 3H are schematic diagrams showing the flow of a high-speed duplex printing operation.

FIG. 2 shows an internal configuration of the printer 100. As shown in FIG. 2, the printer 100 includes a process section 50 (an example of a print section) that forms a toner image by a well-known electrophotographic method, feeder cassettes 91 and 92 in which non-printed sheets are placed, an eject tray 96 in which printed sheets are placed, and a sheet sensor 60 that detects passage of sheets.

Moreover, the printer 100 has an approximately S-shaped convey path 11 (depicted by a one-dot chain line in FIG. 2). The convey path 11 allows a sheet accommodated in the feeder cassette 91 (or 92) positioned in the lower part to be passed through the feeder roller 71 (or 72) and the process section 50 and be guided to a eject tray 96 positioned in the upper part by a eject roller 76.

The sheet sensor 60 is positioned upstream the process section 50 and downstream the feeder roller 71 in the convey direction of sheets and detects whether or not a sheet has passed through a predetermined position of the convey path 11. That is to say, the printer 100 is able to detect passage of the leading edge of a sheet when an output signal from the sheet sensor 60 changes from a state indicative of non-presence of sheet to a state indicative of presence of sheet and to detect passage of the bottom edge of a sheet when the output signal from the sheet sensor 60 changes from a state indicative of presence of sheet to a state indicative of non-presence of sheet. Moreover, the printer 100 determines the time to convey a subsequent sheet in response to the passage of the bottom edge of the sheet, for example.

Moreover, the sheet sensor 60 is used for measurement of a sheet length. That is to say, the printer 100 acquires the time taken from the passage of the leading edge of a sheet to the passage of the bottom edge of the sheet based on the signal from the sheet sensor 60 and calculates the length of the sheet being actually conveyed along the convey path 11 based on the acquired time and the convey speed of the sheet.

The printer 100 of this embodiment picks up the sheets placed in the feeder cassette 91 (or 92) on a one-by-one basis, conveys the picked-up sheet to the process section 50, and transfers a toner image formed in the process section 50 to the sheet. In addition, the sheet having the toner image transferred thereto is conveyed to a fixing section in the process section 50 so that the toner image is thermally fixed onto the sheet. Then, the sheet having the toner image fixed thereto is ejected to the eject tray 96.

Moreover, the printer 100 has a duplex printing mechanism for performing printing on both sides of a sheet. A reconvey path 12 (depicted by a two-dot chain line in FIG. 2) in FIG. 2 is a convey path for reversing a sheet with one side (single side) printed and reconveying it to the process section 50 so as to perform printing on an obverse side (the other side) of the sheet. The reconvey path 12 is branched from the convey path 11 at a branch point 15 that is positioned upstream the eject roller 76 and downstream the process section 50 in the convey direction of sheets. Moreover, the reconvey path 12 forms a path that extends from the branch point 15 along the space between the process section 50 and the feeder cassettes 91 and 92 and converges with the convey path 11 at a side of the convey path 11 located upstream the process section 50.

Specifically, by the duplex printing of the printer 100, the sheets are reversed in the following order. First, a sheet for which single-sided printing is performed along the convey path 11 is conveyed to the eject roller 76. When the bottom edge of the sheet is passed through the branch point 15, the eject roller 76 is temporarily stopped with the sheet pinched. Subsequently, the rotation direction of the eject roller 76 is changed to reverse the convey direction of the sheet, thus conveying the sheet to the reconvey path 12. Then, the sheet is conveyed back to the convey path 11 at a side of the convey path 11 located upstream the process section 50. In this way, the sheet is reversed upside down with the other side printed.

Moreover, the printer 100 has a high-speed duplex printing function of performing single-sided printing on two subsequent sheets and then performing single-sided printing on the other sides of two subsequent sheets at the time of performing duplex printing. Specifically, the sheets are conveyed in the order as shown in FIGS. 3A to 3H.

(A) A preceding sheet S1 which is the first sheet is conveyed to the convey path 11.

(B) Single-sided printing is performed on the preceding sheet S1.

(C) The preceding sheet S1 is conveyed to the reconvey path 12, and a subsequent sheet S2 which is the second sheet is conveyed to the convey path 11.

(D) The preceding sheet S1 is conveyed back to the convey path 11, and single-sided printing is performed on the subsequent sheet S2.

(E) Single-sided printing is performed on the other side of the preceding sheet S1, and the subsequent sheet S2 is conveyed to the reconvey path 12.

(F) The preceding sheet S1 is ejected, and the subsequent sheet S2 is conveyed back to the convey path 11.

(G) Single-sided printing is performed on the other side of the subsequent sheet S2.

(H) The subsequent sheet S2 is ejected.

That is to say, in the high-speed duplex printing of the printer 100, two sheets are conveyed into the printer 100 and printing is performed in the order of single side (first sheet), single side (second sheet), the other side (first sheet), and the other side (second sheet). This convey order results in a shorter standby time for the process section 50 compared to a case (hereinafter referred to as "low-speed duplex printing") where printing is performed in the order of single side of each sheet and the other side of each sheet, thus improving printing quality.

[Electrical Configuration of Printer]

Figures 4, 5:
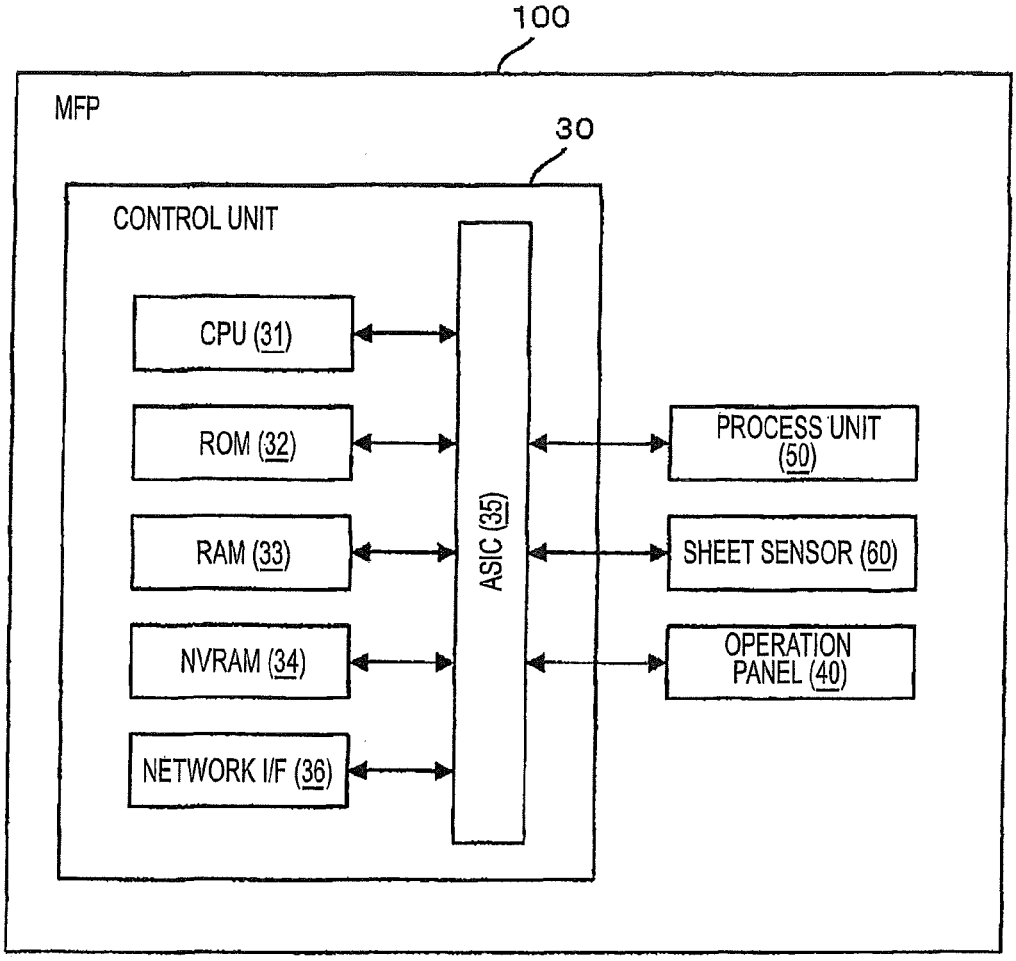
FIG. 4 is a block diagram showing an electrical configuration of the printer shown in FIG. 1.
FIG. 5 shows an example of the conveyability corresponding to a combination of sheets.

Subsequently, an electrical configuration of the printer 100 will be described. As shown in FIG. 4, the printer 100 includes a control section 30 that includes a CPU 31, a ROM 32, a RAM 33, a NVRAM (nonvolatile RAM) 34, an ASIC 35, and a network interface 36. Moreover, the control section 30 is electrically connected to the process section 50, the operation panel 40, the sheet sensor 60, and the like.

The ROM 32 stores various control programs for controlling the printer 100, various setting values, initial values, and the like. The RAM 33 is used as a work area, to which various control programs are read, or a storage area, in which image data are temporarily stored.

The CPU 31 controls various constituent elements (for example, lighting timings of an exposure section, driving motors (not shown) of various rollers that constitute the convey path 11 or the reconvey path 12) of the printer 100 through intervention of the ASIC 35 while storing processing results in the RAM 33 or the NVRAM 34 in accordance with the control programs read from the ROM 32 or signals sent from various sensors.

The network interface 36 is connected to a network such as a LAN and enables connection to an external device in which a printer driver for the printer 100 is installed. The printer 100 is able to exchange print jobs via the network interface 36.

[Duplex Printing Control of Printer]

Subsequently, duplex printing control of the printer 100 will be described. The printer 100 is capable of high-speed duplex printing and performs high-speed duplex printing upon receiving a duplex printing instruction. However, the high-speed duplex printing is not possible if the sheet length in the sheet convey direction is too large. In this case, the high-speed duplex printing is abandoned and low-speed duplex printing or single-sided printing is performed.

In this embodiment, it will be assumed that the three types "A4," "Letter," and "Legal" are supported as the sheet size for which duplex printing is possible. Moreover, it will be assumed that high-speed duplex printing is possible for "A4" and "Letter", but high-speed duplex printing is not possible for "Legal". The respective sheet sizes are as follows:

A4: (Main) 210 mm×(Sub) 297 mm

Letter: (Main) 216 mm×(Sub) 280 mm

Legal: (Main) 216 mm×(Sub) 356 mm

Here, "Main" means the main-scanning direction, and "Sub" means the sub-scanning direction (the sheet convey direction).

Moreover, in many cases, when high-speed duplex printing is performed, the preceding sheet S1 and the subsequent sheet S2 are feed from the same feeder cassette, and thus they have the same sheet size. However, when a feeder cassette that fed the preceding sheet S1 runs short of sheets and sheets are automatically fed from a different feeder cassette, there is a possibility that a sheet of a different size is fed from the feeder cassette. Moreover, there is also a possibility that sheets of different sizes are accommodated in the same feeder cassette.

Furthermore, depending on a combination of the preceding sheet S1 and the subsequent sheet S2, there may be a case where high-speed duplex printing can be continued and a case where high-speed duplex printing cannot be continued. FIG. 5 shows the relationship between the continuability of high-speed duplex printing and combinations of the preceding sheet S1 and the subsequent sheet S2.

In FIG. 5, "O" means that continuous high-speed duplex printing is possible. That is, for a combination of sheets for which high-speed duplex printing is basically possible, continuous high-speed duplex printing will be possible for any combination thereof.

Figure 6:
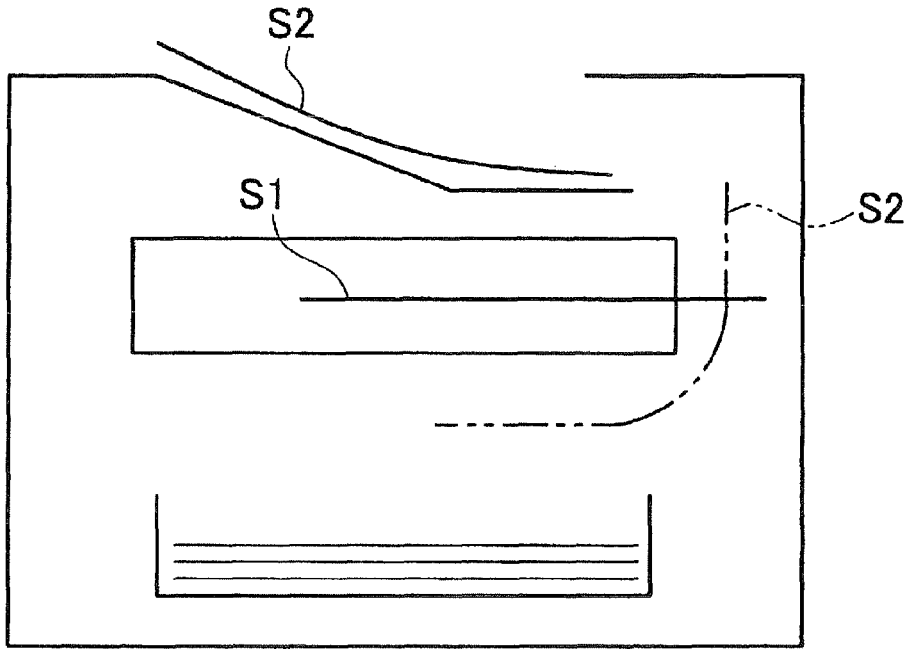
FIG. 6 is a schematic diagram showing a combination of sheets for which high-speed duplex printing is not possible.

In FIG. 5, "X" means that continuous high-speed duplex printing is not possible. That is, if the preceding sheet S1 is "A4" and the subsequent sheet S2 is "Legal," there is a concern that as shown in FIG. 6, the preceding sheet S1 and the subsequent sheet S2 (in the figure, S2 depicted by a dotted line) collide with each other in the course of convey at the convey order shown in FIG. 3E. For this reason, for this combination, printing of the other side of the subsequent sheet S2 is abandoned, and the subsequent sheet S2 is ejected (in the figure, S2 depicted by a solid line).

Figure 7:
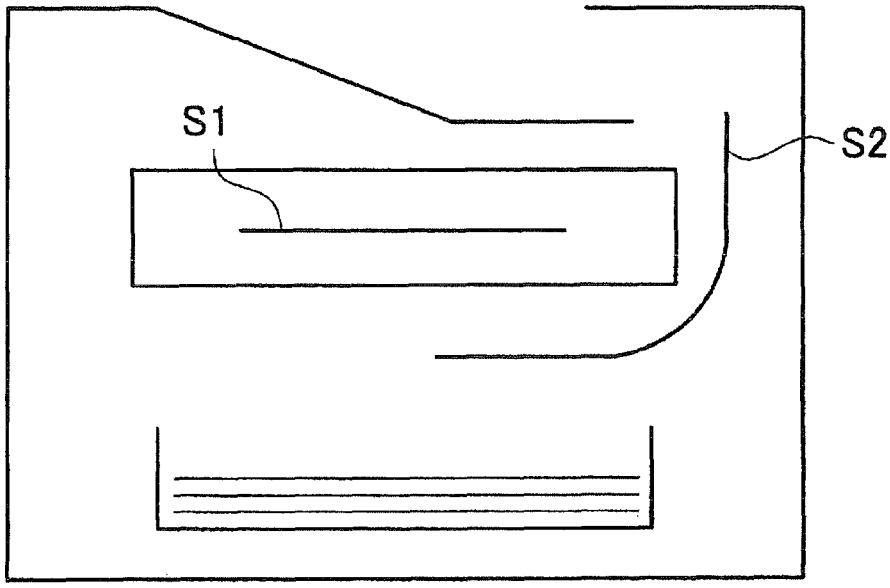
FIG. 7 is a schematic diagram showing a combination of sheets for which high-speed duplex printing is possible.

In FIG. 5, "◎" means that continuous high-speed duplex printing is possible. That is, if the preceding sheet S1 is "Letter" and the subsequent sheet S2 is "Legal," the sheet length of the preceding sheet S1 in the sheet convey direction is small. Thus, for example, as shown in FIG. 7, there is little possibility that the preceding sheet S1 and the subsequent sheet S2 collide with each other in the course of convey at the convey order shown in FIG. 3E. For this reason, high-speed duplex printing is continued for this combination.

In FIG. 5, "-" means a combination that does not exist. That is, the printer 100 switches to low-speed duplex printing from the beginning if the preceding sheet S1 has a size for which high-speed duplex printing is not possible. For this reason, if the preceding sheet S1 is "Legal," its combination with the subsequent sheet 52 does not exist. These sheet size types, and combinations and collision examples thereof are examples only and are not limited thereto.

[Duplex Convey Process]

Figure 8A:
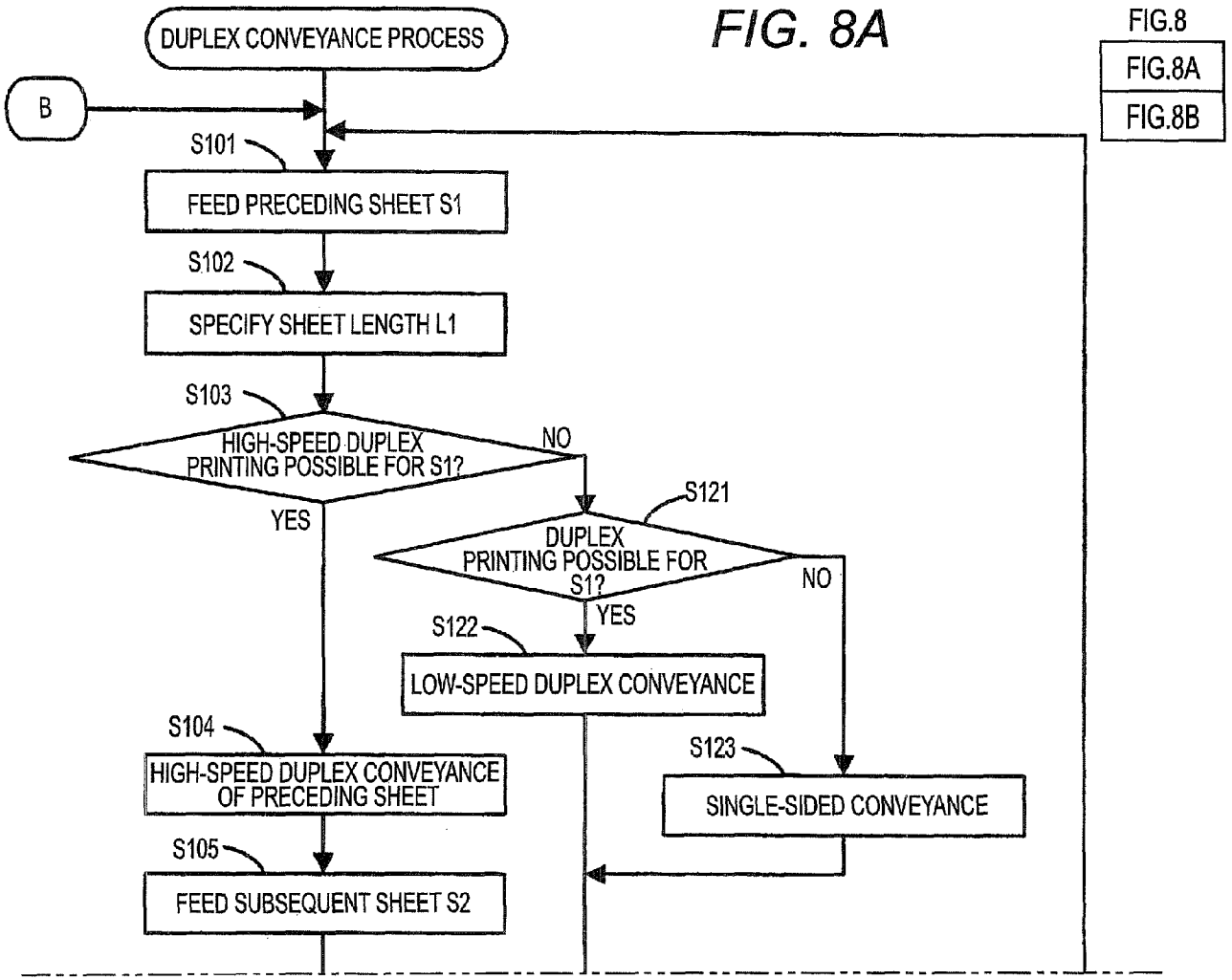
FIG. 8 is a flowchart showing the flow of a duplex printing process.
Figure 8B:
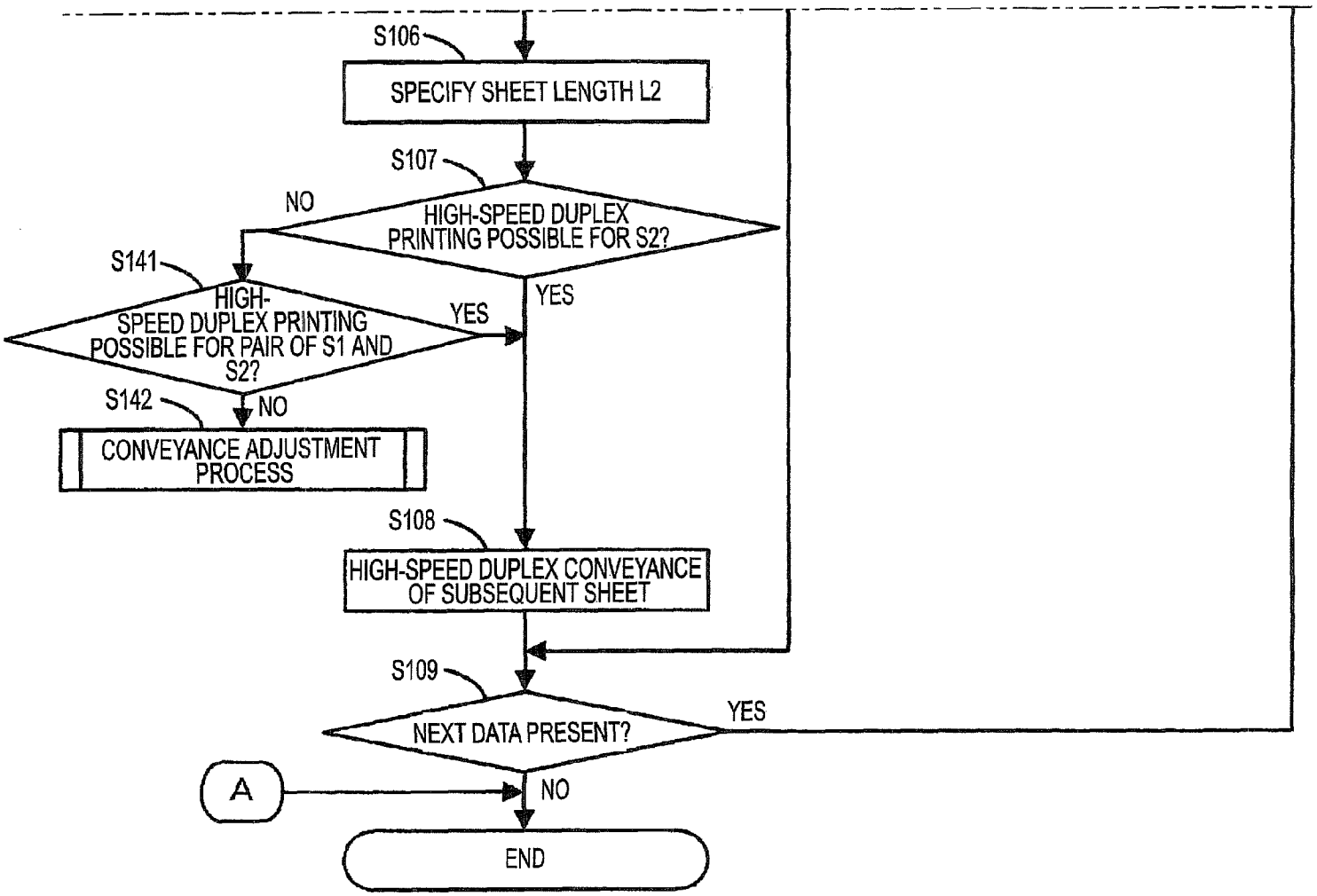

Hereinafter, a duplex convey process (an example of a specifying section, a determination section, and a controller) for realizing the above-described duplex printing control will be described with reference to the flowchart of FIG. 8. This duplex convey process is executed in response to receiving of a duplex print job via the network interface 36.

First, feeding of a preceding sheet S1 is started (S101). For example, when a print job in which "A4" is designated as a sheet size is received, sheets are fed from a feeder cassette that is designated to accommodate A4-size sheets, and conveying control for high-speed duplex printing is started. Thereafter, the sheet sensor 60 detects passage of the preceding sheet S1, thus acquiring the sheet length L1 of the preceding sheet S1 in the strain data (sub-scanning direction) (S102).

Next, based on the sheet length L1, it is determined whether or not high-speed duplex printing is possible for the preceding sheet S1 (S103). That is, it is determined whether or not high-speed duplex printing is possible for the preceding sheet S1 that has been conveyed actually. A threshold value T1 of a sheet length for which high-speed duplex printing is possible is stored in the printer 100. If the specified sheet length L1 is smaller than the threshold value T1, it is determined that high-speed duplex printing is possible. In this embodiment, it is determined that high-speed duplex printing is possible for "A4" or "Letter"-size sheets, whereas it is determined that high-speed duplex printing is not possible for "Legal"-size sheets.

If it is determined that high-speed duplex printing is not possible (S103: NO), it is further determined whether or not duplex printing is possible for the preceding sheet S1 (S121). A threshold value T2 (>T1) of a sheet length for which low-speed duplex printing is possible is stored in the printer 100.

If the specified sheet length L1 is larger than the threshold value T2, it is determined that duplex printing is not possible.

If it is determined that duplex printing is possible (S121: YES), conveying control is switched so that low-speed duplex printing is performed for the preceding sheet S1 (S122). Especially, In a case where the preceding sheet S1 is fed without precedent sheet either in the conveyer 11 or the reconveyer 12, a subsequent sheet is fed after printing the other surface of the preceding sheet S1. On the other hand, if it is determined that duplex printing is not possible (S121: NO), duplex printing is abandoned and conveying control is switched so that single-sided printing is performed for the preceding sheet S1 (S123).

After S122 or S 123, it is determined whether or not next print data are present (S 109), and if print data is present (S109: YES), the flow returns to 5101 to start feeding of the preceding sheet S1, whereas if print data is not present (S109: NO), this process ends.

On the other hands, returning to the description of S103, if it is determined that high-speed duplex printing is possible (S103: YES), conveying control of the preceding sheet S1 is continued so that high-speed duplex printing is performed (S104). Moreover, during the convey of the preceding sheet S1, feeding of a subsequent sheet S2 is started (S105). Then, similar to S102, the sheet sensor 60 detects a passage of the subsequent sheet S2, thus acquiring the sheet length L2 of the subsequent sheet S2 in the strain data (sub-scanning direction) (S106).

Next, based on the sheet length L2, it is determined whether or not high-speed duplex printing is possible for the subsequent sheet S2 (S107). In S107, the determination is made using the same threshold value T1 as S103. If it is determined that high-speed duplex printing is possible (S107: YES), convey of the subsequent sheet S2 is continued so that high-speed duplex printing is performed (S108). Thereafter, it is determined whether or not next print data are present (S109), and if print data is present (S109: YES), the flow returns to S101 to start feeding of the preceding sheet S1, whereas if print data is not present (S109: NO), this process ends.

On the other hand, if it is determined that high-speed duplex printing is not possible (S107: NO), it is further determined whether high-speed duplex printing is possible for a combination of the preceding sheet S1 and the subsequent sheet S2 (S141). A database storing the conveyability corresponding to a combination of sheets as shown in FIG. 5 is stored in the printer 100. Based on a sheet type predicted from the sheet lengths L1 and L2, it is determined whether or not high-speed duplex printing is possible for that combination.

If it is determined that high-speed duplex printing is possible (the "©" case in FIG. 5) (S141: YES), the flow proceeds to S108 to continue the conveyance of the subsequent sheet S2 so that high-speed duplex printing is performed. If it is determined that high-speed duplex printing is not possible (the "X" case in FIG. 5) (S141: NO), a convey adjustment process is performed (S142).

That is to say, even when the subsequent sheet S2 has a sheet length for which high-speed duplex printing is not possible, there may be a case where the possibility of collision is low depending on its combination with the preceding sheet S1. For this reason, rather than uniformly applying error processing in all cases where the subsequent sheet S2 has a sheet length for which high-speed duplex printing is not possible, high-speed duplex printing is continued for a combination with a low possibility of causing troubles.

Figure 9:
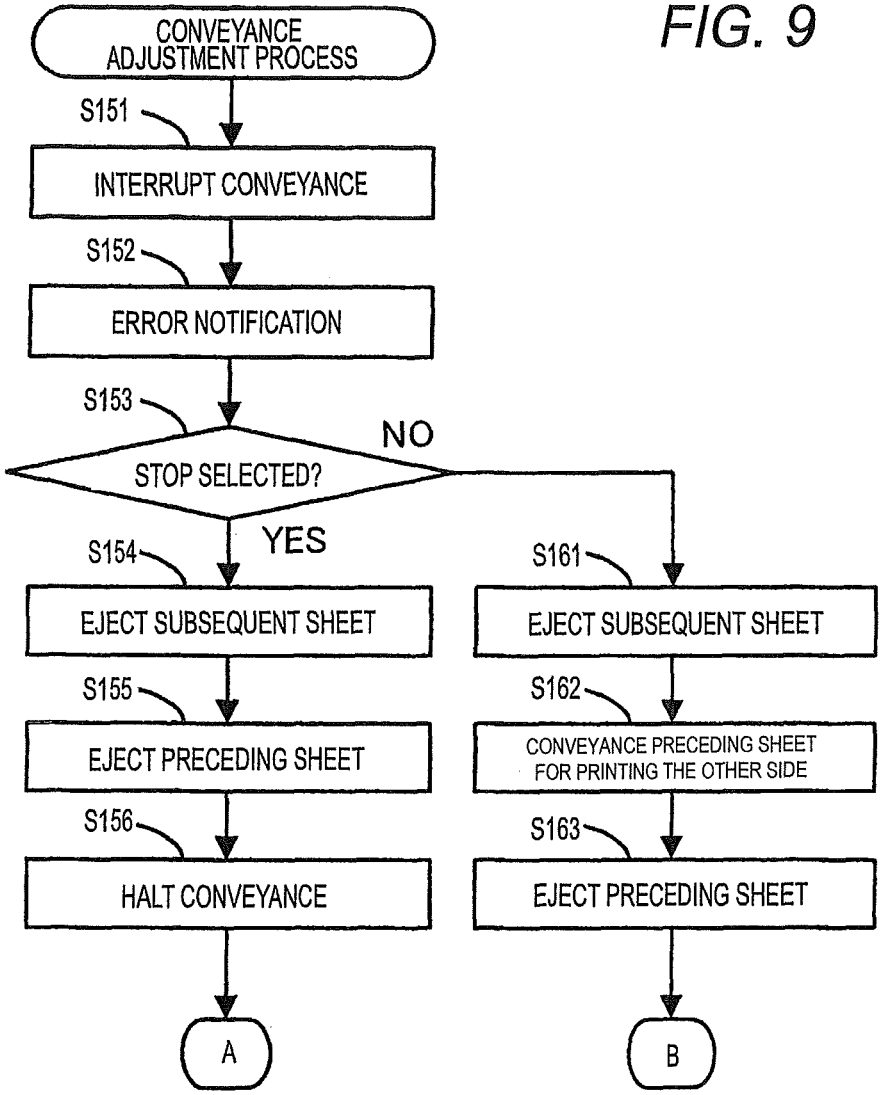
FIG. 9 is a flowchart showing the flow of a convey adjustment process.

Subsequently, details of the convey adjustment process (an example of a command section) in S142 will be described with reference to the flowchart of FIG. 9. First, sheet convey is interrupted (S151), and an error notification concerning the sheet size is sent to a user (S152).

Figure 10:
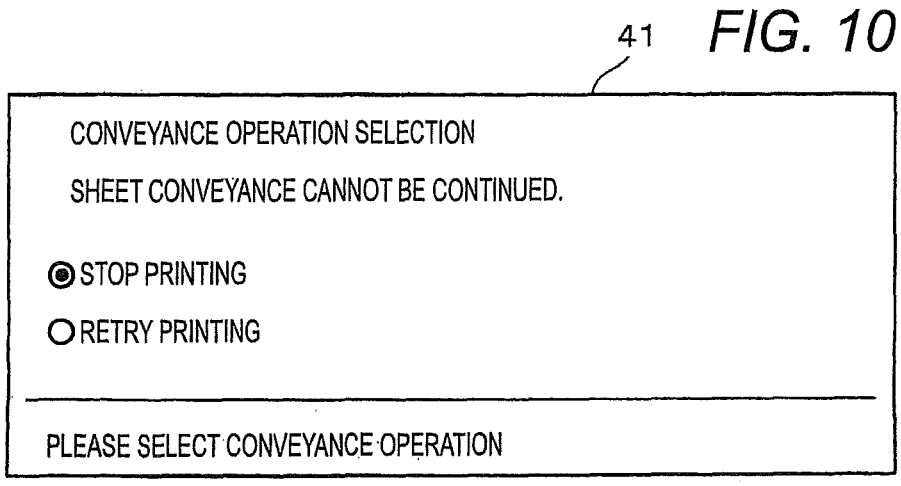
FIG. 10 shows an example of a convey operation selection screen.

In this notification in S152, a screen as shown in FIG. 10, allowing the user to select whether the user will stop or retry printing is displayed on the display section 41 of the operation panel 40 and the user's selection is received.

Next, it is determined whether or not the user has selected to stop printing (S153). When the user has selected to stop printing (S153: YES), the subsequent sheet S2 being conveyed is ejected (S154), the preceding sheet S1 is ejected subsequently (S155), and sheet convey is halted (S156). After S156, the duplex convey process ends. By stopping printing, convey errors such as a paper jam can be avoided. Moreover, the user is able to check sheets in the feeder cassette, replace sheets appropriately, and then start printing all over again.

On the other hand, when the user has selected retry printing (S153: NO), the subsequent sheet S2 is conveyed for single-sided printing and the subsequent sheet S2 is ejected without being conveyed to the reconvey path 12 (S161). In S161, single-sided printing of the subsequent sheet S2 may be performed or not performed actually.

Subsequently, the preceding sheet S1 is conveyed for printing the other side thereof (S162), and then the preceding sheet S1 is ejected (S163). In this way, on the eject tray 96, the preceding sheet S1 with both sides printed is placed on the subsequent sheet S2 on which duplex printing is not yet completed. Thereafter, the flow returns to S101 of FIG. 8 to start feeding of the preceding sheet. That is to say, printing subsequent to the printing of the preceding sheet S1 with both sides printed is retried.

In the retry, the subsequent sheet S2 that resulted in an inappropriate combination is ejected to avoid a sheet collision, and then duplex printing of the preceding sheet S1 is completed. When the preceding sheet S1 is ejected, printing subsequent to the printing of the preceding sheet S1 is retried. In this way, by performing the retry autonomously, it is possible to suppress decrease in productivity. In addition, there is no change in printing order of output sheets after the retry.

In the convey adjustment process, although the timing of asking whether printing will be stopped or retried occurs later than the combination determination and earlier than the eject of the sheets S1 and S2, the asking timing may occur earlier than the start of printing on the other side of the preceding sheet S1. That is to say, the subsequent sheet S2 is ejected with the other side not printed regardless of whether printing is stopped or retried. Therefore, the asking as to whether printing will be stopped or retried may be made after the subsequent sheet S2 is ejected.

As described in detail above, the printer 100 of this embodiment specifies the lengths of sheets being conveyed actually and switches conveying control of the sheets based on the results of determination on the combination of the preceding sheet S1 and the subsequent sheet S2 (target sheet) in addition to the sheet lengths of the sheets S1 and S2. In this way, depending on the size of the sheets being conveyed actually, it is possible to perform an appropriate duplex printing operation. For example, when the combination of sheets is inappropriate, by discharging the subsequent sheet S2 without conveying the sheet to the reconvey path 12, it is possible to avoid a collision with the preceding sheet S1. Moreover, for a combination where the preceding sheet S1 has the "Letter" size and the subsequent sheet S2 has the "Legal" size, even if the sheet sizes are different, high-speed duplex printing is possible. For this reason, rather than uniformly applying error processing for stopping printing in all cases where the sheet sizes are different, by continuing high-speed duplex printing of that combination, it is possible to suppress decrease in productivity resulting from stopped convey.

Moreover, the printer 100 does not halt the sheet convey even if the preceding sheet S1 has a sheet length for which high-speed duplex printing is not possible. That is to say, the sheet convey is continued by switching the sheet conveying control to low-speed duplex printing or single-sided printing. In this way, it is possible to avoid convey errors and suppress decrease in productivity resulting from stopped convey.

This embodiment is an example only and does not limit the present invention. Accordingly, various improvements and modifications may be made without departing from the scope of the present invention. The present invention is not limited to a printer but can be applied to any apparatus having a printing function such as a multi-functional peripheral or a FAX machine. Moreover, the image forming method of the process section is not limited to an electrophotographic method but may be an ink jet method. Furthermore, the printer may be capable of forming color images and may be configured to form only monochrome images.

Moreover, although the high-speed duplex printing according to the embodiment involves single-sided printing on both sides of two subsequent sheets, the number N of subsequent printing sheets is not limited to 2. The maximum number N of subsequent printing sheets differs depending on the number of sheets that can be conveyed along the sheet convey path. Moreover, the number of sheets that can be conveyed along the sheet convey path is determined by the length of the sheet convey path, the sheet length in the convey direction, and the like. That is to say, the number N of subsequent printing sheets is not limited to 2 but may be 3 or more.

Moreover, in the example of the high-speed duplex convey according to the embodiment, single-sided printing is performed on single sides of two subsequent sheets and then on the other sides of the same two subsequent sheets. However, single-sided printing may be performed on single sides of plural subsequent sheets and then alternately on the other side and the single side of sheets. For example, the number N of subsequent printing sheets may be set to 2 at the time of starting the sheet convey operation, and then single-sided printing may be performed alternately on the single side and the other side of sheets. In this case, when duplex printing of 4 sheets is performed, for example, printing is performed in the order of single side (first sheet), single side (second sheet), the other side (first sheet), single side (third sheet), the other side (second sheet), single side (fourth sheet), the other side (third sheet), and the other side (fourth sheet). The present invention can be applied to this convey order.

Moreover, in the embodiment, although as a method of specifying the sheet length, the time passed from passage of the leading edge of a sheet to passage of the bottom edge of the sheet is measured using the sheet sensor 60, the specifying method is not limited to this. For example, a method of reading a sheet length from information (for example, information stored in an IC tag) embedded in a sheet may be used.

Moreover, in the embodiment, although the subsequent sheet S2 is ejected if it is determined that continued high-speed duplex printing is not possible for the combination of the preceding sheet S1 and the subsequent sheet S2, the present invention is not limited to this. That is to say, the preceding sheet S1 may be ejected instead of the subsequent sheet S2. In this case, it should be made sure that the determination on the combination with the subsequent sheet S2 is completed before the preceding sheet S1 is conveyed to the reconvey path 12. At that time, only the preceding sheet S1 may be ejected, and both the preceding sheet S1 and the subsequent sheet S2 may be ejected.

OTHER ASPECTS OF THE EXEMPLARY EMBODIMENTS

The second aspect of the exemplary embodiments of the present invention is that the conveyer ejects the second sheet without conveying the second sheet into the reconveyer in a case where the determination section determines the pair of the first sheet and the second sheet is eligible for the high-speed duplex printing. According to this configuration, it is possible to make the inappropriate pair of the sheets less effective to the printing process. For example, if the printing apparatus ejects the first sheet, print the one surface and the other surface of the second sheet in advance, then retries to print the contents to be printed on the first sheet, the printing apparatus prints the sheets in a different order from initially intended. To the contrary, when the second sheet is ejected, the printing order does not change.

The third aspect of the exemplary embodiments of the present invention is that the controller controls the printing section to continue printing on the other surface of the first sheet and the controller controls the printing section to print contents to be printed on the one surface and the other surface of the second sheet on a third sheet, when the determination section determines the pair of the first sheet and the second sheet is not eligible for the high-speed duplex printing. According to this configuration, even though the pair of the first sheet and the second sheet is inappropriate for the high-speed duplex printing, it is expected to suppress the reduction in productivity by automatically reprinting.

The fourth aspect of the exemplary embodiments of the present invention is that the printing apparatus further comprises a command section ordering the controller to cancel or continue printing before the printing section continue printing the other surface of the first sheet, wherein the controller controls the printing section to eject the first sheet after ejecting the second sheet when the command section orders the controller to cancel printing; and the controller controls the printing section to print the contents to be printed on the one surface and the other surface of the second sheet on the third sheet when the command section orders the controller to continue printing. According to this configuration, the user's intention is clearly reflected by making it possible to select a command to cancel the printing or a command to continue the printing.

The fifth aspect of the exemplary embodiments of the present invention is that the controller controls the printing section to eject the first sheet after ejecting the second sheet and to cancel printing, when the determination section determines the pair of the length of the first sheet and the length of the second sheet is not eligible for the high-speed duplex printing. According to this configuration, it is possible to restart the printing while preventing sheet jam in a case where the pair of the first sheet and the second sheet is not eligible for the high-speed duplex printing.

The sixth aspect of the exemplary embodiments of the present invention is that the second sheet is fed after printing the other surface of the first sheet in a case where the first sheet is fed without precedent sheet in either the conveyer or the reconveyer and the first sheet is determined not to be eligible for the high-speed duplex printing. According to this configuration, the printing can be continued even when the first sheet initially fed into the printing section is not eligible for the high-speed duplex printing.

The invention claimed is:

1. A printing apparatus comprising:

a printing section comprising:

a conveyer configured for conveying a first sheet and a second sheet subsequent to the first sheet;

a printer configured for printing one surface and the other surface of the first sheet, and printing one surface and the other surface of the second sheet; and a reconveyer configured for conveying the first sheet after printing the one surface of the first sheet and conveying the second sheet after printing the one surface of the second sheet, wherein the printing section is configured for performing a high-speed duplex printing where the printer prints the one surface of the first sheet, the one surface of the second sheet after the first sheet is in the reconveyer, and the other surface of the first sheet in this order;

a sensor configured for determining a length of the first sheet while the conveyer conveys the first sheet and a length of the second sheet while the conveyer conveys the second sheet;

a determination section configured for determining whether a pair of the first sheet and the second sheet is eligible for the high-speed duplex printing based on the combination of the length of the first sheet and the length of the second sheet after the second sheet is conveyed by the conveyer and before the second sheet is conveyed by the reconveyer; and a controller configured for controlling the printing section to convey the first sheet and the second sheet to the reconveyer when the determination section determines the pair of the length of the first sheet and the length of the second sheet is eligible for the high-speed duplex printing, and controlling the printing section to eject at least one of the first sheet and the second sheet when the determination section determines the pair of the length of the first sheet and the length of the second sheet is not eligible for the high-speed duplex printing, wherein the second sheet is ejected before being conveyed by the reconveyer when the determination section determines the pair of the length of the first sheet and the length of the second sheet is not eligible for the high-speed duplex printing, and wherein the controller is configured for controlling the printing section to continue printing on the other surface of the first sheet and to control the printing section to print contents to be printed on the one surface and the other surface of the second sheet on a third sheet, when the determination section determines the pair of the length of the first sheet and the length of the second sheet is not eligible for the high-speed duplex printing.

2. The printing apparatus according to claim 1, further comprising:

a command section configured for ordering the controller to cancel or continue printing before the printing section continue printing the other surface of the first sheet, wherein the controller is configured to control the printing section to eject the first sheet after ejecting the second sheet when the command section orders the controller to cancel printing; and the controller is configured to control the printing section to print the contents to be printed on the one surface and the other surface of the second sheet on the third sheet when the command section orders the controller to continue printing.

3. The printing apparatus according to claim 1, wherein the sensor is configured for determining the length of the first sheet by comparing a threshold time with an interval time during which the first sheet passes over the sensor, and the sensor is configured for determining the length of the second sheet by comparing the threshold time and an interval time during which the second sheet passes over the sensor.

4. A printing method with a printing apparatus which comprises a conveyer conveying a first sheet and a second sheet; a printer printing one surface and the other surface of the first sheet and printing one surface and the other surface of the second sheet; and a reconveyer conveying the first sheet after printing the one surface of the first sheet and conveying the second sheet after printing the one surface of the second sheet, the printing method comprising:

feeding the first sheet;

determining a length of the first sheet;

feeding the second sheet subsequent to the first sheet;

determining a length of the second sheet;

performing a high-speed duplex printing where printing the one surface of the first sheet, the one surface of the second sheet after the first sheet in the reconveyer, and the other surface of the first sheet in this order;

determining whether a pair of the first sheet and the second sheet is eligible for the high-speed duplex printing based on the combination of the length of the first sheet and the length of the second sheet after the conveyor conveys the second sheet and before the reconveyer conveys the second sheet;

conveying the first sheet and the second sheet to the reconveyer if the pair of the length of the first sheet and the length of the second sheet is eligible for the high-speed duplex printing;

ejecting at least one of the first sheet and the second sheet if the pair of the length of the first sheet and the length of the second sheet is not eligible for the high-speed duplex printing;

ejecting the second sheet before the second sheet is conveyed by the reconveyer when determining that the pair of the length of the first sheet and the length of the second sheet is not eligible for the high-speed duplex printing; and controlling to continue printing on the other surface of the first sheet and controlling to print contents to be printed on the one surface and the other surface of the second sheet on a third sheet, when determining that the pair of the length of the first sheet and the length of the second sheet is not eligible for the high-speed duplex printing.

5. The printing method according to claim 4 wherein, the second sheet is fed after printing the other surface of the first sheet in a case where the first sheet is fed without a precedent sheet in either the conveyer or the reconveyer and the first sheet is determined not to be eligible for the high-speed duplex printing.

* * * * *